United States Patent [19]

Grover et al.

[11] 4,040,714

[45] Aug. 9, 1977

[54] C-CLAMP GROUND ADAPTERS

[75] Inventors: Vijay K. Grover, Warren; Woodie Zachry, Troy, both of Mich.

[73] Assignee: Airco, Inc., Montvale, N.J.

[21] Appl. No.: 683,857

[22] Filed: May 6, 1976

[51] Int. Cl.[2] ..... H01R 11/26

[52] U.S. Cl. ..... 339/264 R

[58] Field of Search ..... 339/108–110, 339/263, 264, 266

[56] References Cited

U.S. PATENT DOCUMENTS

| | | | |
|---|---|---|---|
| 1,968,736 | 7/1934 | Bodendieck | 339/264 L |
| 2,461,687 | 2/1949 | Hopfeld | 339/264 R |

FOREIGN PATENT DOCUMENTS

| | | | |
|---|---|---|---|
| 909,000 | 10/1962 | United Kingdom | 339/264 R |

*Primary Examiner*—Joseph H. McGlynn
*Attorney, Agent, or Firm*—David L. Rae; Larry R. Cassett; Edmund W. Bopp

[57] ABSTRACT

A ground adapter is used in conjunction with a C-clamp for providing a connection between a ground cable from, for example an electric arc welding machine, to a ground object such as a workpiece. The ground adapter and ground object are firmly retained in contact with one another by a conventional C-clamp. The ground adapter is comprised of a ground base which is designed to receive one or more electrical cables. A plurality of adjustable cowling members may be disposed about one pad or foot of the C-clamp and are releasably secured to the ground base. The location of cowling members on the ground base is adjustable which enables use of the ground adapter with C-clamps having pads of varying sizes. Upon tightening the spindle or threaded portion of the C-clamp against the ground adapter, the cowling members of which are in firm contact with one pad of the clamp and against the ground base, a reliable physical and electrical contact is maintained between the ground adapter and the ground object thereby enabling completion of an electrical circuit as, for example, is required during electric arc welding operations.

10 Claims, 3 Drawing Figures

C-CLAMP GROUND ADAPTERS

BACKGROUND OF THE INVENTION

The present invention relates to ground clamps and, more particularly, to ground adapters for use with C-clamps in connecting electrical cables to a ground object.

In order to complete an electrical circuit for enabling performance of electric arc welding and metal removing operations, it is necessary to connect one terminal of a welding machine (power supply) to ground potential. In electric arc welding operations, it is common to connect one terminal of the welding machine to an electrode while the remaining terminal is connected through a suitable adapter to a ground object, such as the workpiece. However, as extremely high currents, up to 3,000 amps are generated during the course of such operations, it is necessary to effect a secure connection between the ground object and electrical ground cable which connection does not produce excessive heat or significant voltage drops thereacross.

C-clamp devices have been used to connect electrical cables to a ground object. Previously, this connection has been effected by securing the cable to the body of the C-clamp such that upon tightening the spindle, a ground object is retained between a pad and foot portion of the C-clamp body. Another type of prior art device is shown in U.S. Pat. No. 2,420,895 wherein a special C-clamp and connecting lug are utilized. It has been found that prior art ground devices have suffered from the disadvantage of generating excessive amounts of heat as well as producing undesirable voltage drops simply due to the resistance of the ground device. Furthermore, prior art ground devices utilized with C-clamps have not been sufficiently flexible in that particular ground devices have been generally suitable only for a single sized C-clamp and have not been found suitable for use with a wide range of C-clamp sizes. This has been particularly true with respect to relatively large C-clamps which have correspondingly large feet or pads. Accordingly, prior art ground clamping devices have not proven effective in use with C-clamps of sizes required to retain relatively large ground objects or workpieces, e.g. 4–6 inches thick, in contact with a typical prior art ground lug or device. Therefore, it has been found that a clear need exists for a ground adapter useable with a wide variety of sizes of conventional C-clamps.

OBJECTS OF THE INVENTION

It is an object of the present invention to provide improved ground adapters for connecting electrical cables to ground objects.

It is another object of the present invention to provide improved ground adapters suitable for use with C-clamps of, and having feet or pads of, a wide variety of sizes.

It is still another object of the present invention to provide improved ground adapters suitable for heavy duty, high current use, for carrying currents of up to 3,000 amps. from an electrical cable to a ground object without developing excessive heat or significant voltage drops across the adapter.

It is yet another object of the present invention to provide improved adapters of simple construction yet enabling firm, reliable contact between one or more electrical cables and a ground object.

Other objects of the present invention will become apparent from the detailed description of an exemplary embodiment thereof which follows and the novel features of the present invention will be particularly pointed out in conjunction with the claims appended hereto.

SUMMARY

In accordance with the present invention, a C-clamp ground adapter for connecting electrical cables to a ground object upon retention of said adapter and ground object in a C-clamp comprises a ground base, means for connecting one or more electrical cables to the ground base, and a plurality of adjustable cowling members for receiving one pad of a C-clamp, the cowling members being releaseably secured to said ground base to retain the received pad in contact with the base with the location of the secured cowling membes determined by the size of the received pad. Thus, by providing such adjustablecowling members, C-clamps having pads of various sizes may be firmly and reliably secured to the ground base of the adapter in accordance with the present invention. In this manner a high degree of flexibility of use of the instant ground adapter is achieved. The ground base is preferably comprised of copper although other electrically conductive materials which do not generate excessive amounts of heat or produce significant voltage drops upon high current flow therethrough may be utilized as well. In addition, one or more electrical cables, such as the ground cables connected to an electric arc welding or metal removing machine or power supply may be connected to the ground base of the adapter. Suitable retention screw means may be utilized to effect the connection of such electrical cables to the ground base although other electrical contact devices may also be utilized in accordance with the teachings of the present invention.

The cowling members of the ground adapter according to the present invention may be of unitary construction and preferably include flat and angularly ascending portions, the latter portion being effective to engage a similarly angled side of the pad or foot of a conventional C-clamp. Preferably, a pair of cowling members are utilized in connection with the instant ground adapter, although more than two of such cowling members are provided with a plurality of slots or other apertures such that screws or other adjustable fastening members may extend therethrough to engage threaded portions or the like of the ground base. In this manner, the position of the cowling members on the ground base and hence, the size of a housing for the pad or foot of the C-clamp to be received in such housing (cowling members and ground base) may be adjustably set thus enabling the ground adapter of the present invention to be utilized with any of a wide variety of sizes of C-clamps.

BRIEF DESCRIPTION OF THE DRAWING

The invention will be more clearly understood by reference to the following description of an exemplary embodiment thereof in conjunction with the following drawing in which.

DESCRIPTION OF PREFERRED EMBODIMENT

Figure 1:
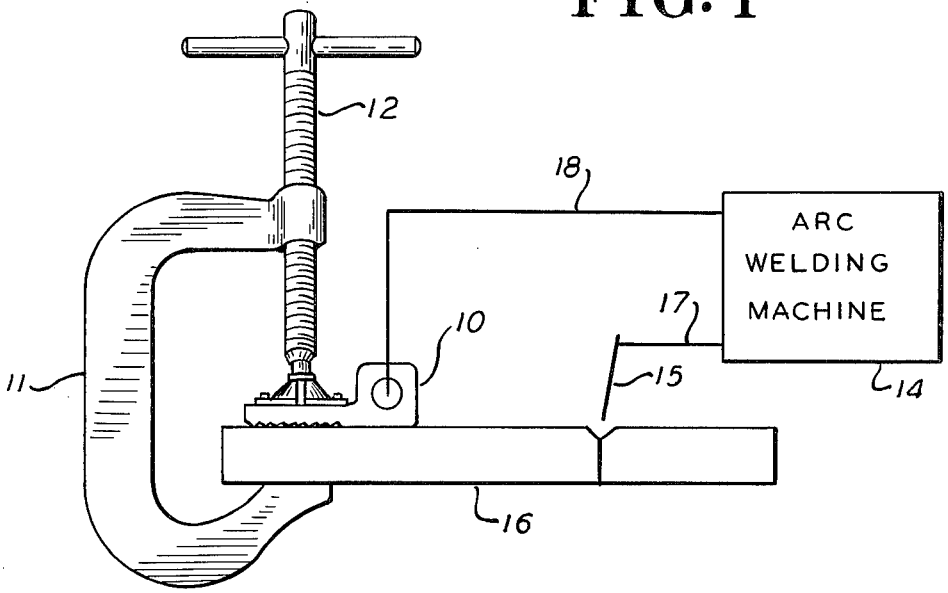
FIG. 1 is a diagrammatic view of a ground adapter retained in a C-clamp and in the electrical circuit of an arc welding machine.

Referring now to FIG. 1 of the drawing, illustrated therein is an exemplary embodiment of a ground adapter 10 which is provided with a C-clamp 11 having a typical threaded portion or spindle 12 securely maintaining adapter 10 and ground object 16 which may comprise a workpiece in electrical and physical contact. A source of electrical current, which may comprise an electric arc welding machine 14, or other power supply such as is used in connection with carbon arc metal removing processes, is provided with one terminal thereof connected through cable 17 to an electrode 15 while the other terminal of machine 14 is connected through cable 18 to ground adapter 10. In this manner, ground object or workpiece 16 is coupled through adapter 10 and cable 18 to the appropriate terminal of arc welding machine 14. Therefore, upon supplying a suitable current through cable 17 and electrode 15, a complete electrical circuit is provided by way of workpiece or ground object 16, ground adapter 10 and electrical cable 18.

Figure 2:
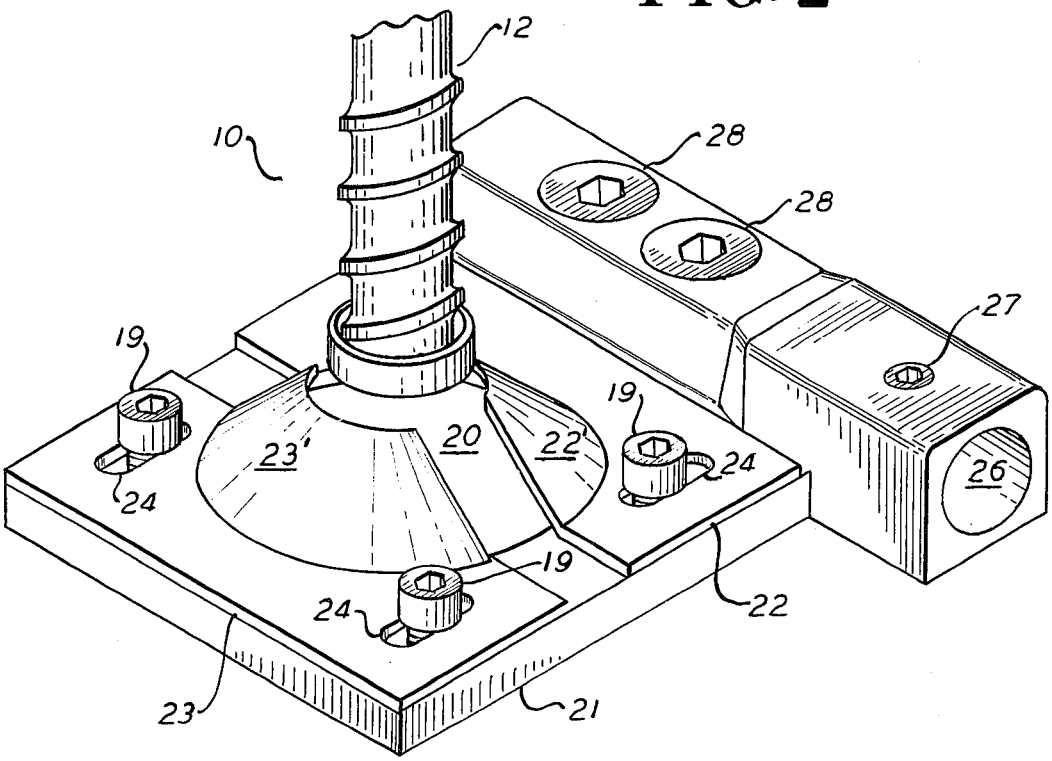
FIG. 2 is an isometric view of the ground adapter according to the present invention.

Referring now to FIG. 2, illustrated therein is an exemplary embodiment of a ground adapter 10 firmly connected to the foot or pad 20 extending from threaded portion 12 of a typical C-clamp. Ground adapter 10 is generally comprised of a ground base 21, adjustable cowling members 22 and 23, a cavity 26 and approriate fastening means and suitable apertures therefor as will be subsequently described. Ground base 21 is preferably a substantially solid mass of an electrically conductive material such as copper which does not generate excessive heat upon passage of electical currents up to 3,000 amps. therethrough. Although ground base 21 is preferably comprised of copper, it is understood that other electrically conductive materials may also be utilized in lieu of copper. Ground base 21 is preferably provided with a suitable cavity 26 for receiving an end of an electrical cable such as cable 18 illustrated in FIG. 1. Commonly, the insulation about the end of such a cable is stripped away such that a screw 28 or other suitable retention member or device may be inserted through one or more apertures in ground base 21 thereby engaging such stripped cable portion and providing a firm, reliable electrical contact between the stripped portion and ground base 21. A further retaining screw 27 is preferably inserted into a suitably threaded aperture in ground base 21 and is effective to provide a gripping or retaining force against an unstripped or insulated portion of the cable received in cavity 26. It is within the scope of the present invention to utilize fastening or connecting means other than screws or the like, to provide the necessary electrical contact between ground base 21 and a cable received in cavity 26 thereof. In addition, it will be understood that more than one cavity 26 may be formed in a suitable portion of ground base 21 such that a corresponding plurality of electrical cables may be received in and connected to ground base 21.

Adjustable cowling members 22 and 23 are preferably provided with a relatively lower or flat portion having a plurality of slots or the like 24 formed therein and an angularly ascending portion 22' and 23', respectively. A corresponding number of screws 19 are preferably provided such that upon tightening screws 19 in slots 24, the position or location of cowling members 22 and 23 on ground base 21 may be adjustably fixed. The angularly ascending portions 22' 23' of the cowling members are preferably of a shape or geometry which corresponds to the geometry of the sloping side portions of the pads or feet of typical conventional C-clamps. It will be understood that although two cowling members 22 and 23 are illustrated in connection with this exemplary embodiment of the ground adapter according to the present invention, three or more symmetrical, adjustable cowling members may be provided as well. In addition, although cowling members 22 and 23 are preferably of a unitary construction, other types of construction may be utilized.

In order to secure ground adapter 10 to the pad or foot 20 of a C-clamp 11 (FIG. 1), screws 19 are loosened or removed thereby enabling adjustable cowling members 22 and 23 to be freely movable along or removable from the top surface of ground base 21. C-clamp pad 20 is placed on the upper surface of ground base 21 and adjustable cowling members 22 and 23 are fitted around pad 20 such that this pad is effectively received in a housing or shroud formed by cowling members 22 and 23. Upon adjustment or tightening of screws 19, adjustable cowling members 22 and 23 will be secured against the sloping surface of pad 20 thereby releasably securing ground base 21 to pad 20 of C-clamp 11. As the position or location on ground base 21 at which cowling members 22 and 23 may be set is adjustable or variable as a consequence of providing slots 24 therein, it will be appreciated that the ground adapter comprised of base 21 and adjustable cowling members 22 and 23 is highly flexible and may be utilized to receive the pad of C-clamps of a wide range of sizes.

Figure 3:
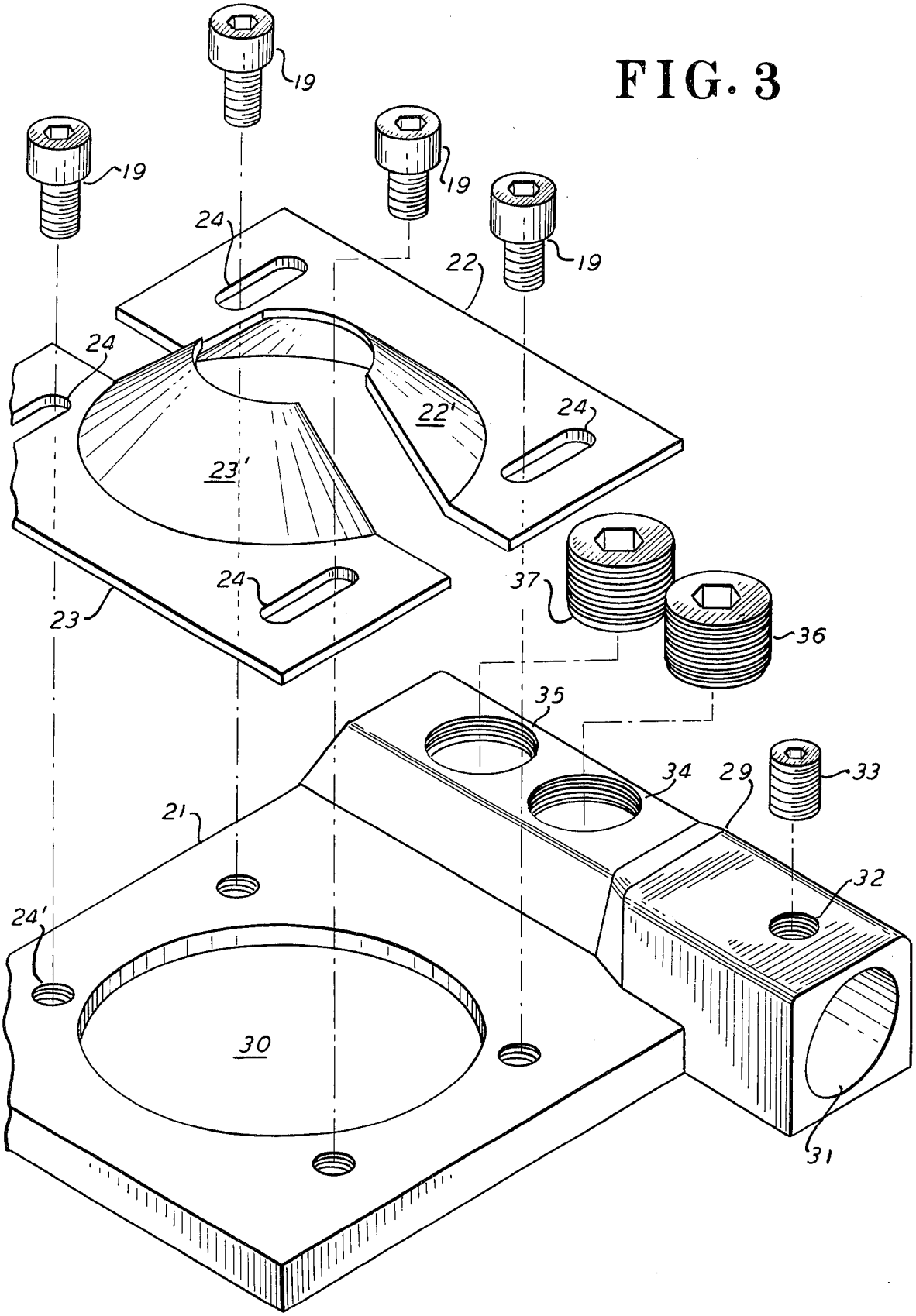
FIG. 3 is an exploded isometric view of the ground adapter according to the present invention.

A further exemplary embodiment of the ground adapter according to the present invention is illustrated in FIG. 3. As certain portions of the ground adapter shown in this figure have been discussed in connection with the adapter illustrated in FIGS. 1 and 2, further discussion of such portions is deemed unnecessary. With respect to FIG. 3, it is noted that ground base 21 is provided with an enlarged cable receiving portion 29 which in turn is provided with a stepped internal cavity 31. Preferably, a threaded aperture 32 is adapted to receive a small socket head screw 33 which in turn engages and retains the unstripped or insulated portion of a cable inserted into cavity 31. In addition, threaded apertures 34 and 35 extend through porton 29 into cavity 31 such that upon appropriate adjustment of large dome or clamp screws 36 and 37, electrical and physical contact between such screws and the stripped, conductive portion of a cable inserted into cavity 31 is assured. In this manner, ground base 21 is retained in physical and electrical contact with a cable inserted into cavity 31. As mentioned heretofore, such a cable may comprise the ground cable of an electric arc welding machine or a power supply of an electric arc metal removing apparatus.

Preferably, ground base 21 is provided with a plurality of threaded apertures 24' for receiving cowling screws 19 as well as a slight depression 30 as illustrated in FIG. 3. The purpose of depression 30, which may be of a size and geometry corresponding to the largest C-clamp pad to be retained by adjustable cowling members 22 and 23 in contact with ground base 21, is to increase the holding action and consequently reduce slippage of such a pad retained in ground adapter 10.

The foregoing and other various changes in form and details may be made without departing from the spirit and scope of the present invention. Consequently, it is intended that the appended claims be interpreted as including all such changes and modifications.

What is claimed is:

1. A C-clamp adaptor for connecting electrical cables to an object upon retention of said adapter and said object in a C-clamp comprising a base; means for connecting one or more electrical cables to said base; a plurality of adjustable cowling members for receiving one pad of a C-clamp each of said cowling members including a base portion and an angularly ascending portion with said base portion having at least one slot formed therein; and means extending through said slot for releasably securing said cowling members to said base to retain said pad in contact with said base with the secured location of said cowling members corresponding to the size of said received pad.

2. An adapter as defined in claim 1 wherein said base is comprised essentially of copper and is of sufficient thickness and area to pass an electrical current of up to 3,000 amps. to said object without developing a significant voltage drop across said base.

3. An adapter as defined in claim 1 wherein said one or more electrical cables are connected between said base and an electric arc welding machine.

4. An adapter as defined in claim 1 wherein said electrical cables are connected between said base and a power supply for a carbon arc metal removing apparatus.

5. An adapter as defined in claim 1 wherein said means for releasably securing said cowling members comprise screws extending through corresponding slots and threadably engaging said base.

6. An adapter as defined in claim 5 wherein the ascending portion of each cowling member is effective to engage said C-clamp pad.

7. An adapter as defined in claim 1 wherein said base is provided with a depression therein for facilitating retention of said pad against said base.

8. An adapter as defined in claim 7 wherein the geometrical configuration of said depression corresponds to the geometry of the bottom surface of said C-clamp pad with the area of said depression being equal to or greater than the area of the bottom surface of said pad.

9. An adapter as defined in claim 1 wherein said means for connecting said one or more cables comprise a portion of said base having a cavity into which one of said cables may be inserted and clamp screws extending through apertures in said base portion for retaining a stripped portion of said cable in contact therewith.

10. An adapter as defined in claim 9 wherein said means for connecting said electical cables also include a further clamp screw for retaining the unstripped portion of said cable in said cavity.

* * * * *